US007465179B1

(12) United States Patent
Tseng

(10) Patent No.: US 7,465,179 B1
(45) Date of Patent: Dec. 16, 2008

(54) BASE FOR INSTALLATION OF ENERGY-EFFICIENT LIGHT BULBS

(76) Inventor: Ming-Chi Tseng, No. 18, Jhensing E. St., Wufong Township, Taichung County 413 (TW)

( * ) Notice: Subject to any disclaimer, the term of this patent is extended or adjusted under 35 U.S.C. 154(b) by 0 days.

(21) Appl. No.: 11/882,141

(22) Filed: Jul. 31, 2007

(51) Int. Cl.
*H01R 33/02* (2006.01)

(52) U.S. Cl. ..... 439/235; 362/221

(58) Field of Classification Search ..... 439/235–242, 439/617; 362/221, 382; 336/96
See application file for complete search history.

(56) References Cited

U.S. PATENT DOCUMENTS 5,013,253 A * 5/1991 Aiello et al. ..... 439/235
5,169,227 A * 12/1992 Korte et al. ..... 362/657
5,260,678 A * 11/1993 Van Wagener et al. ..... 336/96
6,048,220 A * 4/2000 Altman et al. ..... 439/235

* cited by examiner

*Primary Examiner*—Michael C Zarroli
(74) *Attorney, Agent, or Firm*—Rosenberg, Klein & Lee

(57) ABSTRACT

A base for the installation of a plurality of energy-efficient light bulbs includes: a plurality of light bulb connectors, each of which has at least two conductive terminals; a connecting part, which is connected among the light bulb connectors, wherein a wire is provided to electrically connect the conductive terminals of the corresponding electrodes of the light bulb connectors; and at least two quick connection devices provided inside the connecting part for the connection of external lines, each of which is electrically connected with the wire of the corresponding electrode in the connecting part. Therefore, the external lines can electrically connect to the light bulb connectors via the quick connection devices.

3 Claims, 5 Drawing Sheets

BASE FOR INSTALLATION OF ENERGY-EFFICIENT LIGHT BULBS

BACKGROUND OF THE INVENTION

1. Field of Invention

The invention relates to a base for the installation of several energy-efficient light bulbs and, in particular, to an energy-efficient light bulb base with a quick connection device.

2. Related Art

As shown in FIG. 5, the conventional base for the installation of several energy-efficient light bulbs has two light bulb connectors 91 connected by a connecting part 92. Both sides of the connecting part 92 are provided with through holes 921 for wires to go through. Each light bulb connector 91 has two conductive terminals 911. The conductive terminals 911 in the two light bulb connectors 91 are electrically connected via the connecting part 92.

For the convenience of connecting with an external power supply, the energy-efficient light bulb base usually uses several short wires 93 to fix on the conductive terminals 911 of the corresponding electrodes. The short wires go through the through holes 921 of the connecting part 92. Since the connecting part 92 has a limited space inside, it is sometimes difficult to arrange the short wires 93.

The short wires 93 for the energy-efficient light bulb base to connect outside are indispensable materials. Very often short wires of different sizes and specifications are required according to customer's demands before the production. Therefore, it is impractical to stock the energy-efficient light bulb base.

Consequently, it is the objective of the invention to solve the above-mentioned problems.

SUMMARY OF THE INVENTION

An objective of the invention is to provide a base for the installation of several energy-efficient light bulbs. Using a quick connection device for the electrical connection between conductive terminals inside the base, the disclosed base can be directly connected with the exterior in a quick way. It is not necessary to disassemble the base structure and the wires therein. Therefore, the invention can save working time and material cost.

In accord with the above objective, the invention includes: a plurality of light bulb connectors, each of which has at least two conductive terminals; a connecting part connected among the light bulb connectors, wherein the conductive terminals of corresponding electrodes are electrically connected using a wire; and at least two quick connection devices disposed inside the connecting part for wire connections to the exterior, each of which is electrically connected with the wire of the corresponding electrodes inside the connecting part.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
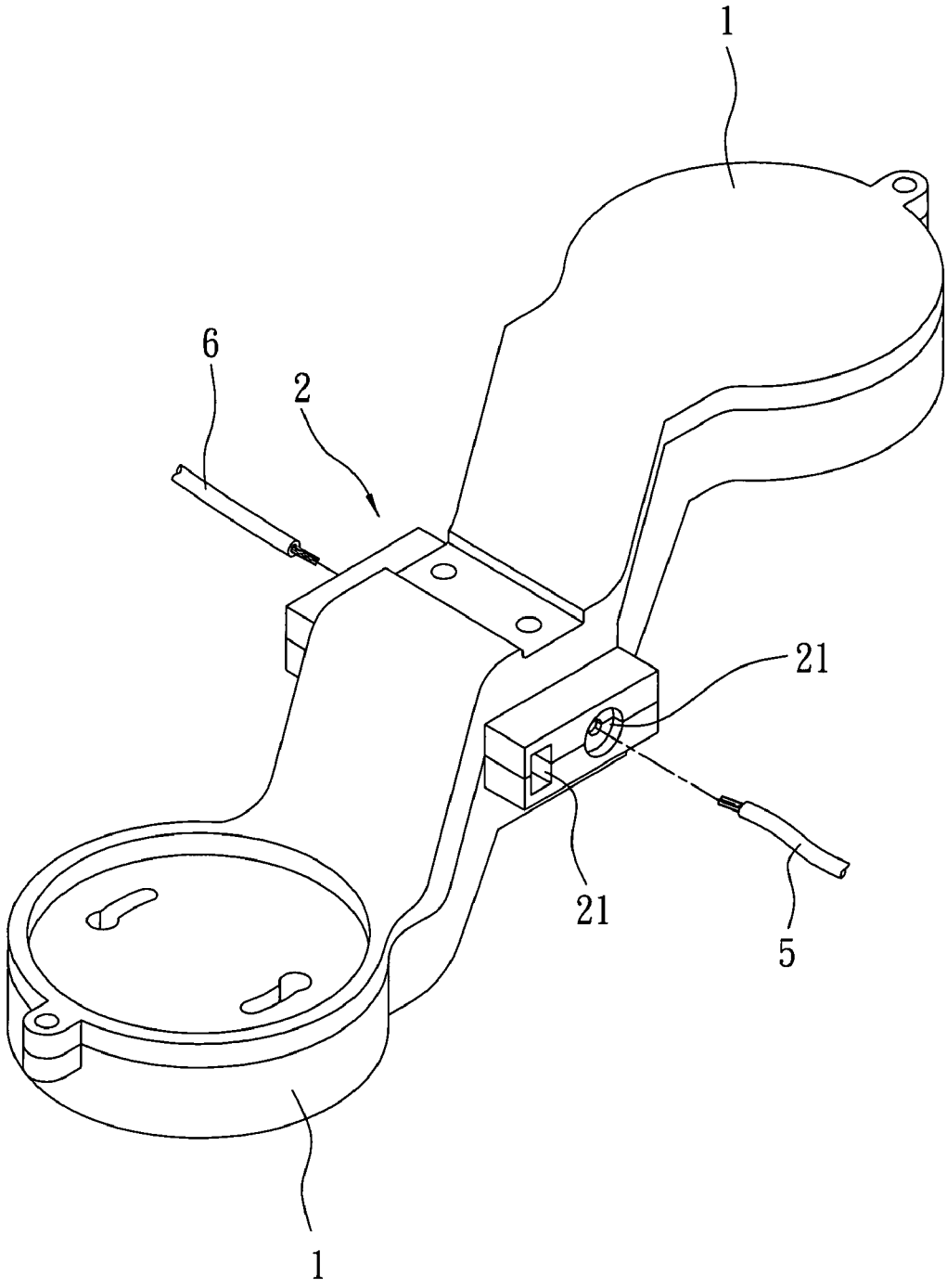
FIG. 1 is a three-dimensional view of the appearance of the invention.
Figure 2:
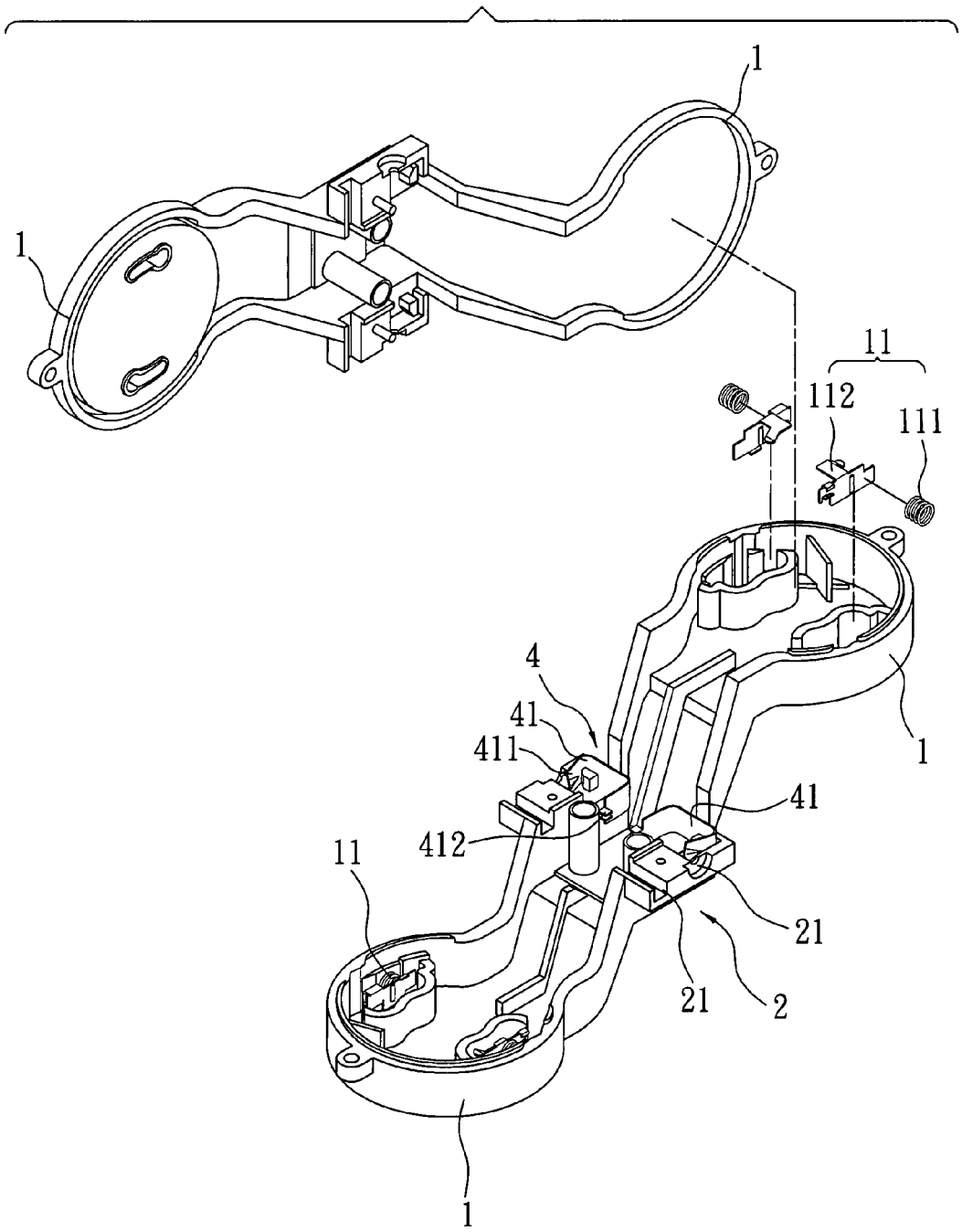
FIG. 2 is a three-dimensional exploded view of the invention.

The present invention will be apparent from the following detailed description, which proceeds with reference to the accompanying drawings, wherein the same references relate to the same elements.

An embodiment of the invention is a base for the installation of several energy-efficient light bulbs. It includes: several light bulb connectors 1, a connecting part 2, and at least two quick installation devices 4 for wire connections.

Each light bulb connector 1 is provided at least two conductive terminals 11 inside. In this embodiment, the number of the light bulb connectors 1 is two, and the number of conductive terminals 11 inside each light bulb connector 1 is two as well. Each conductive terminal 11 consists of a conductive plate 112 pushed by a spring 11. One conductive terminal 11 of the light bulb connector is connected to a 110V AC source, and the other conductive terminal 11 is connected to a 0V AC source. For the convenience of explanation, this embodiment uses the AC power supply and the 110V home electricity voltage. The invention, however, is not restricted by such examples. It can use other types of AC voltages or DC power supplies.

The connecting part 2 is connected among the light bulb connectors 1. The conductive terminals 11 of the corresponding electrodes in the light bulb connectors 1 are electrically connected using a wire 3 through the connecting part 2. In this embodiment, the connecting part 2 is connected between the two light bulb connectors 1. Both sides of the connecting part 2 are provided with two through holes 21, respectively.

The quick connecting devices 4 are disposed corresponding to the through holes 21 in the connecting part 2. The conductive terminals 11 of the corresponding electrodes in each light bulb connector 1 are electrically connected with the corresponding quick connection device 4. In this embodiment, the two opposite through holes 21 inside the connecting part 2 are respectively provided with a quick connection device 4. One of them is connected with an external 110V AC source; the other is connected with an external 0V AC source. A power switch (not shown in the drawing) is provided near the external power source for controlling the on and off of the base. The power switch can be a wall switch, drawing switch, or some other equivalent apparatus.

Figure 3:
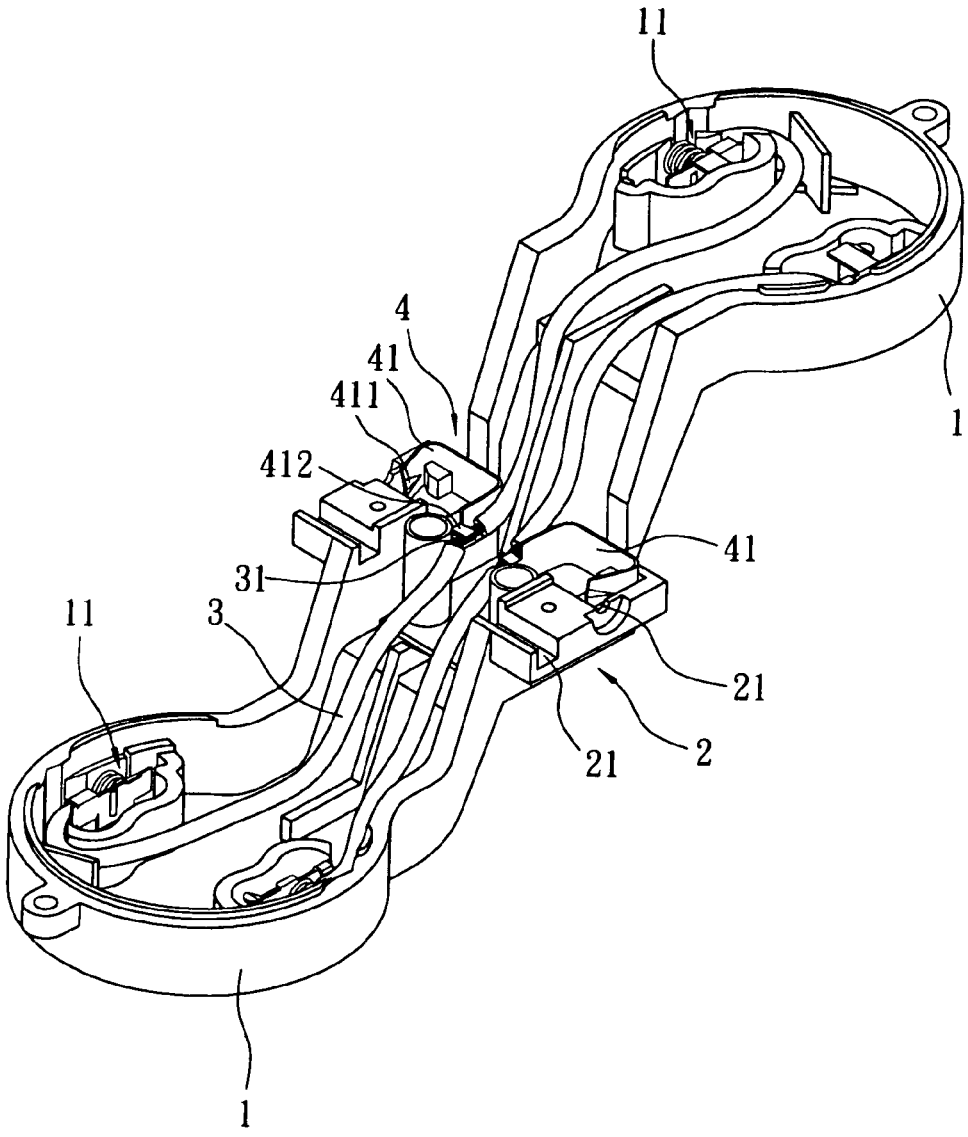
FIG. 3 is a schematic view showing the electrical connection of the invention.
Figure 4:
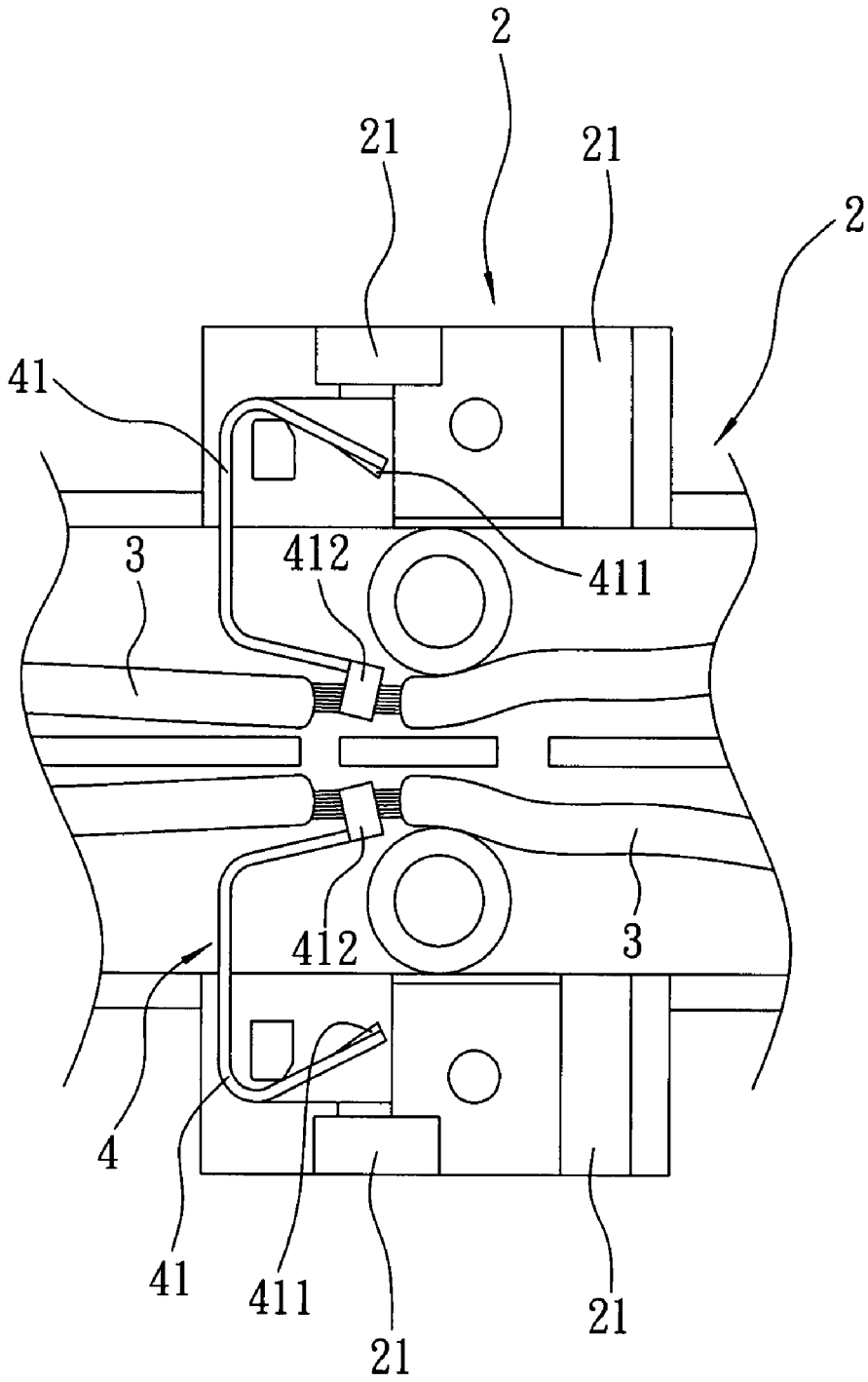
FIG. 4 is a schematic view showing the connection of the quick connection devices and the wires.
Figure 5:
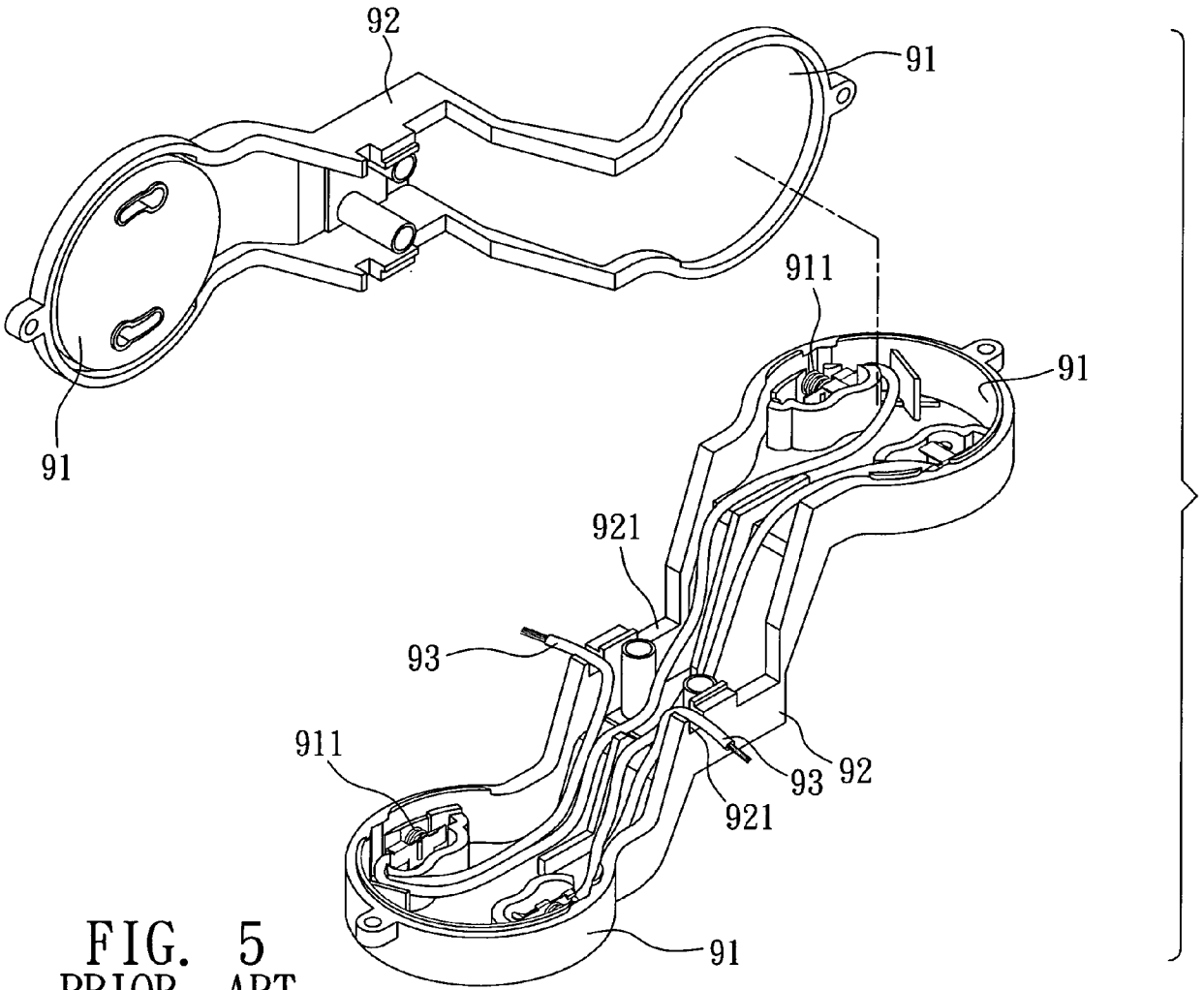
FIG. 5 PRIOR ART
FIG. 5 is a three-dimensional exploded view of the conventional energy-efficient light bulb base.

The quick connection device 4 in this embodiment is made by providing a fixed copper plate 41 for the external wire in each of the two opposite through holes 21 inside the connecting part 2, as shown in FIGS. 3 and 4. The side of the copper plate 41 opposite to the through hole 21 is a holding part 411 for fixing an external wire. The other side is a fixing part 412 for the electrical connection of the corresponding electrode in the connecting part 2. Each of the copper plates 41 of the quick connection device 4 is connected with an exposed portion of the wire 31 of the corresponding electrode using its fixing part 412, and then connected to the connecting part 2. The conductive terminals 11 for the connection with the 110V AC source inside the two light bulb connectors 1 are electrically connected with the quick connection device 3 that is connected with the 110V AC source. The other two conductive terminals 11 for the connection with the 0V AC source are electrically connected with the quick connection 3 that is connected with the 0V AC source.

When the invention is in use, the power line 5 connected with the external 110V AC source and the power line 6 connected with the 0V AC source are plugged into the two quick connection devices 4, respectively. The copper plate 41 inside the connecting part 2 can hold and fix the exposed parts of the power lines 5, 6 inside the connecting part 2, so that the conductive terminals 11 are electrically connected with the external power lines 5, 6. When the external power switch is turned on, the AC current is sent via the external power lines 5, 6 to the corresponding quick connection device 4. Each of the conductive terminals 4 then sends the power to the energy-efficient light bulbs (not shown) to light them up.

In summary, the invention is featured in that due to the design of quick connection devices 4 inside the connecting part 2, there is no need to provide short wires for the conductive terminals 11 of the energy-efficient light bulb base. The connection between the quick connection devices 4 and the conductive terminals 11 enables the connection with the external power lines 5, 6. Thus, space considerations are not a concern, also the production does not need to take into account the size and specification of the external power lines.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A base installation of a plurality of energy-efficient light bulbs, comprising:

a plurality of light bulb connectors, each of which is provided with at least two conductive terminals;

a connecting part, which is connected among the light bulb connectors, wherein a wire is used to electrically connect the conductive terminals of the corresponding electrode of the light bulb connectors inside the connecting part; said wire having an exposed portion; and at least two quick connection devices, disposed inside the connecting part, connecting external wires, and electrically connected with the exposed portion of the wire of the corresponding electrode in the connecting part; said connection devices spatially separated from the conductive terminals.

2. The base installation of a plurality of energy-efficient light bulbs as of claim 1, wherein the connecting part is connected with two light bulb connectors, each of the light bulb connectors having two conductive terminals, and two quick connection devices provided inside the connecting part.

3. A base installation of a plurality of energy-efficient light bulbs, comprising:

a plurality of light bulb connectors, each of said plurality provided with at least two conductive terminals;

a connecting part connected among the light bulb connectors, wherein a wire electrically connects the conductive terminals of the corresponding electrode of the light bulb connectors inside the connecting part; and at least two quick connection devices disposed inside the connecting part connecting external wires and electrically connected with the wire of the corresponding electrode in the connecting part wherein the connecting part has a plurality of through holes and each of the quick connection devices has a flexible copper plate in each of the through holes, an end opposite to the through hole a holding part holding external lines and another end a fixing part electrically connected with the wire of the corresponding electrode inside the connecting part.

* * * * *